US005414990A

United States Patent [19]

Blazek et al.

[11] Patent Number: 5,414,990

[45] Date of Patent: May 16, 1995

[54] PROCESS AND DEVICE FOR CONVEYING FIBERS IN AN AIRSTREAM IN AN OPEN-END SPINNING ROTOR

[75] Inventors: Petr Blazek, Chocen; Stanislav Didek, Usti N. Orlici, both of Czechoslovakia

[73] Assignee: Rieter Ingolstadt Spinnereimaschinenbau AG, Ingolstadt, Germany

[21] Appl. No.: 98,264

[22] PCT Filed: Dec. 18, 1992

[86] PCT No.: PCT/DE92/01065

§ 371 Date: Dec. 2, 1993

§ 102(e) Date: Dec. 2, 1993

[87] PCT Pub. No.: WO93/12279

PCT Pub. Date: Jun. 24, 1993

[30] Foreign Application Priority Data

Dec. 18, 1991 [CS] Czechoslovakia ..... 3861-91

[51] Int. Cl.[6] ..... D01H 4/00; D01H 11/00

[52] U.S. Cl. ..... 57/411; 57/301; 57/302; 57/414; 57/415; 57/417

[58] Field of Search ..... 57/301, 302, 411, 414, 57/415, 417

[56] References Cited

U.S. PATENT DOCUMENTS

| | | | |
|---|---|---|---|
| 3,796,034 | 3/1974 | Grau | 57/302 |
| 3,845,612 | 11/1974 | Chisholm et al. | 57/302 |
| 3,859,779 | 1/1975 | Furstenberg | 57/302 X |
| 4,339,910 | 7/1982 | Ali et al. | 57/411 |
| 4,510,745 | 4/1985 | Kawabata et al. | 57/302 X |
| 4,539,808 | 9/1985 | Miyamoto et al. | 57/411 |

FOREIGN PATENT DOCUMENTS

| | | | |
|---|---|---|---|
| 71452 | 2/1983 | European Pat. Off. . | |
| 2126841 | 1/1973 | Germany . | |
| 2709761 | 9/1978 | Germany | 57/301 |
| 2809008 | 9/1979 | Germany | 57/301 |
| 3935419 | 6/1990 | Germany . | |
| 1357211 | 6/1974 | United Kingdom . | |

*Primary Examiner*—Daniel P. Stodola
*Assistant Examiner*—William Stryjewski
*Attorney, Agent, or Firm*—Dority & Manning

[57] ABSTRACT

To spin a yarn with an open-end rotor spinning device, the fibers are fed to a fiber guiding surface from which the fibers are deposited on the sliding wall of a spinning rotor after passing over a gap. At the same time, an air stream is guided through the gap into the interior of the spinning rotor and is then removed from the interior of the spinning rotor without passing through the gap again. To produce the air stream, a device for the production of a pressure drop which produces the air flow flowing into the interior of the spinning rotor is assigned to the gap (17).

33 Claims, 3 Drawing Sheets

PROCESS AND DEVICE FOR CONVEYING FIBERS IN AN AIRSTREAM IN AN OPEN-END SPINNING ROTOR

BACKGROUND OF THE INVENTION

The instant invention relates to a process for the spinning of a yarn by means of an open-end device with a spinning rotor in which the fibers are fed to a fiber guiding surface which widens in the direction of the spinning rotor, from which the fibers are deposited on a widening sliding surface of the spinning rotor after overcoming a gap, as well as a device to carry out this process.

The problem exists with open-end rotor spinning that the fiber substance in the produced yarn is not utilized optimally so that yarns of poorer quality than ring yarns are produced as a result. In a known device of the type mentioned above this problem is addressed in that the fibers to be spun are conveyed to a rotating fiber guiding surface of a guiding body which widens in the direction of the spinning rotor, from which they are transferred to the rotating inner wall of the spinning rotor (DE-OS 21 26 841). Although this principle results in considerable improvement of the yarn structure and characteristics. This advantage is however counteracted by the disadvantage that fiber loss occurs due to the fact that air streams out through the gap between the guiding body and the upper edge of the spinning rotor carry fibers as they pass from the guiding body to the inner wall of the spinning rotor. On the other hand this gap, of a certain size, is required as a certain quantity of air is needed to convey the fibers through the feed channel, this quantity of air having to be removed again after the fibers are separated from the air. The gap must be of sufficient size so that the required amount of air can be removed through it. Even when the fiber loss affects especially short fibers, this is a great disadvantage.

OBJECTS AND SUMMARY OF THE INVENTION

It is a principal object of the instant invention to improve the known principle of fiber drafting and thereby to improve the structure of the yarn while avoiding fiber losses. Additional objects and advantages of the invention will be set forth in the following description, or may be obvious therefrom, or may be learned through practice of the invention.

The objects are attained through the invention in that an air stream is guided through the gap into the interior of the spinning rotor and is then removed from the interior of the spinning rotor without passing the gap again. In this manner, an air stream which ensures that the fibers will overcome the gap and will be deposited on the inner wall of the spinning rotor from where they are then fed in the conventional manner to the fiber collection groove for spinning is produced at the point where the fibers are able to escape from the space enclosed by the fiber collection surface and the spinning rotor. Independently of whether the fiber guiding surface is stationary or rotates, a rotating air stream caused by the rotation of the spinning rotor is always produced along the fiber guiding surface and conveys the fibers fed to the fiber guiding surface to the end of the fiber guiding surface toward the gap. This circulating air stream then combines with the air stream introduced through the gap into the spinning rotor and is then removed together with it from the space enclosed by the fiber guiding surface and the spinning rotor without passing the gap again at any point on the periphery of the spinning rotor. It has been shown that the air to be removed thus reaches the center of the space enclosed by the fiber guiding surface and the spinning rotor and thus does not interfere with the conveying of fibers. This type of fiber feeding and air control leads to a considerable improvement of the yarn structure and to considerably better utilization of the load-bearing capacity of the spun fibers and thereby to a considerable increase in yarn strength and improved yarn characteristics.

The air stream entering the interior of the spinning rotor through the gap can be produced in different manners. In an advantageous embodiment of the process according to the invention, this air stream is produced by compressed air which is fed to the outer perimeter of the gap, or alternatively by a suction air stream which is removed from the spinning rotor. It is here also possible to produce the suction air stream through the rotation of the spinning rotor. In that case, provisions can be made that the suction air stream produced by the rotation of the spinning rotor and removed from the spinning rotor is again introduced into the spinning rotor through the gap so that a circulation airstream is produced.

In an advantageous further development of the process according to the invention, the air stream is removed, in relation to the gap, toward the side from which the fibers are fed, whereby the air stream is advantageously removed essentially diametrically opposed to the fiber conveying direction in relation to the circular surface enclosed by the fiber guiding surface.

In this way, a large portion of the air conveying the fibers to the fiber guiding surface is caused to separate early from the rotating air which conveys the fibers along the fiber guiding surface to the spinning rotor. This facilitates the entry of air through the gap so that the air pressure outside the spinning rotor producing this air stream can be set at a lower level than could otherwise be selected. In this way no overpressure need be produced in the space surrounding the gap, but depending on geometric conditions, it suffices if the space surrounding the gap is at normal atmospheric pressure.

In an especially advantageous process the fibers are conveyed to the fiber guiding surface by means of an air stream, whereby a large portion of this air stream is removed from the spinning device in sharp deflection while the remainder of this air, together with the fibers, is conveyed along a helicoidal path to the widened end of the fiber guiding surface, from where the fibers are transferred past the gap to the sliding wall of the spinning rotor. In this manner, the air stream entering through the gap prevents the fibers from exiting through the gap, whereupon the fibers reach the fiber collection groove in a known manner to be spun while the air conveyed through the gap into the interior of the spinning rotor is removed from the spinning rotor without passing the gap again. It has been shown that, with the present invention, structure improvement of the yarn and an increase of its strength can be achieved in an especially simple manner.

In order to facilitate the conveying of fibers from the fiber guiding surface to the inner wall of the spinning rotor, it is advantageous if the air flowing into the spinning rotor contains components which are directed against the bottom of said spinning rotor. The air streaming into the spinning rotor thus blows the fibers leaving the fiber guiding surface in the direction of the inner wall of the spinning rotor and thus assists in their being deposited on the inner wall of the spinning rotor and their being conveyed to the fiber collection groove.

The air streaming through the gap into the spinning rotor is advantageously adapted to the material to be spun. This adaptation is effected advantageously by changing the gap width. In this manner it is not required to change the capacity of a source of overpressure or negative pressure so that the management of air acting upon the spinning process is not changed substantially. The adjustment of the gap width can be achieved easily through a relative adjustment of fiber guiding surface and spinning rotor.

To carry out the process, the invention provides that a device is assigned to the gap to produce a pressure drop which provokes an air stream flowing through the gap into the interior of the spinning rotor. This prevents the fibers from being withdrawn from the spinning process.

The device for the production of the pressure drop is constituted according to the invention by a compressed-air source assigned to the portion of the housing which surrounds the gap, or by a source of negative pressure acting in the interior of the spinning rotor. It may be sufficient, depending on the design of the open-end spinning device, if normal atmospheric pressure prevails outside the spinning rotor in the area of the gap, since even then a pressure drop producing an air stream flowing through the gap into the spinning rotor is created because of the negative pressure inside the spinning rotor.

The source of negative pressure acting in the spinning rotor can be an external source of negative pressure or can be constituted by at least one ventilation opening eccentrically located in the spinning rotor.

The source of negative pressure acting in the interior of the spinning rotor preferably comprises the inlet opening of a suction line which is located on the same side of the gap as the fiber feeding device. It has been shown that the air pressure applied to the outer periphery of the gap can assume a lower value in this manner than otherwise requires in order to produce the necessary pressure drop from the outside to the inside. In this way, it is possible, under certain circumstances, to connect the outer periphery of the gap to the atmosphere so that a source of overpressure connected to the outside of the gap can be omitted. An especially advantageous air flow can be achieved in accordance with the invention in that the fiber feeding device is provided with a fiber feeding channel which ends eccentrically inside the ring-shaped fiber guiding surface, whereby the inlet opening of the suction line is located in the other half of the circular surface enclosed by the ring-shaped fiber guiding surface. In order to assist in the deflection of the air stream arriving through the fiber feeding channel or through some other fiber feeding device, it is advantageous to provide a starting groove which becomes gradually wider in the direction of the outlet of the suction line and is located on an arc of circle in the face of the cover toward the spinning rotor.

If the fiber feeding device is provided with a fiber feeding channel, it is advantageous that the end of the latter be located in a projection of the cover, just as the inlet opening of the suction line. The projection extends substantially concentrically into the space surrounded by the ring-shaped fiber guiding surface. To achieve especially secure transfer of the fibers from the fiber guiding surface to the inner wall of the spinning rotor, it is advantageous for the fiber guiding surface to extend into the spinning rotor.

For design reasons the fiber guiding surface is preferably not rotatable, with the ring-shaped guiding body being advantageously an integral part of the cover covering the housing which contains the spinning rotor.

In another advantageous embodiment of the invention, the spinning rotor and the fiber guiding surface are axially adjustable in relation to each other. It is thus possible, not only to control the flow intensity of the air flow entering the spinning rotor through the gap, but depending on the penetrating depth of the guiding body supporting the fiber guiding surface, this air stream can also be directed with greater or lesser force toward the inner wall of the spinning rotor. By changing the penetration depth of the guiding body into the spinning rotor, the fiber deposit on the inner wall of the spinning rotor is influenced through change of flow intensity as well as through a change of the direction of flow.

In order to facilitate fiber feeding upon the sliding wall of the spinning rotor without much fiber deflection, especially with a stationary, i.e. non-rotatable fiber guiding surface, the end of the fiber feeding surface toward the spinning rotor is advantageously oriented so that its extension intersects the sliding surface of the spinning rotor between the gap and the fiber collection groove.

In an embodiment of the spinning rotor with at least one ventilation opening, it is of advantage if the periphery of the spinning rotor in which the ventilation openings are located, and the periphery of the gap between spinning rotor and fiber guiding surface, are separated by an intermediate wall installed in the housing and allowing the spinning rotor to rotate. Such an intermediate wall makes it possible, in a simple manner, to separate the two above-mentioned peripheral zones with the possibility of assigning dedicated adjusting means to each peripheral zone for the adjustment of the desired flow conditions. The intermediate wall can be located on the outer wall of the spinning rotor and reach to within immediate proximity of the inner wall of the housing, so that good sealing is achieved on the one hand without interfering with the rotation of the rotor on the other hand. Thereby the replaceability of the spinning rotor is facilitated on the one hand, and this is of special importance in the case of spinning rotors which are supported by means of supporting disks. On the other hand, the spinning rotors are made relatively heavy by the integrated intermediate wall, and this leads to greater drive energy requirement. For this reason the intermediate wall is preferably borne by the housing, insofar as this is possible from a design point of view. Such a design is the precondition for another advantageous embodiment of the invention in which the peripheral area of the spinning rotor, in which at least one ventilation opening is provided, is joined to the atmosphere and the periphery of the gap between spinning rotor and fiber guiding surface is joined to a source of overpressure.

In another alternative advantageous embodiment of the device according to the invention, the peripheral area of the spinning rotor in which at least one ventilation opening is located is jointed within the housing to the peripheral area of the gap between spinning rotor and fiber guiding surface. In this case it is possible to constitute the intermediate wall of segments which can be adjusted in relation to each other to regulate the air stream which leaves the (at least one) ventilation opening and enters the spinning rotor through the gap.

Fiber losses which in known devices of the type described are unavoidable and sometimes significant and can be avoided with the help of the process and the device according to the invention without having to accept disadvantages affecting yarn structure and yarn strength. It has been shown, on the contrary, that the yarn structure is considerably improved over that of conventional rotor yarns. Better use is made of the load-bearing capacity of the spun fibers than in conventional yarns, and this increases the strength of the yarn. The improvement of yarn structure also leads to a better aspect of the obtained yarn.

DETAILED DESCRIPTION OF THE PREFERRED EMBODIMENTS

Figure 1:
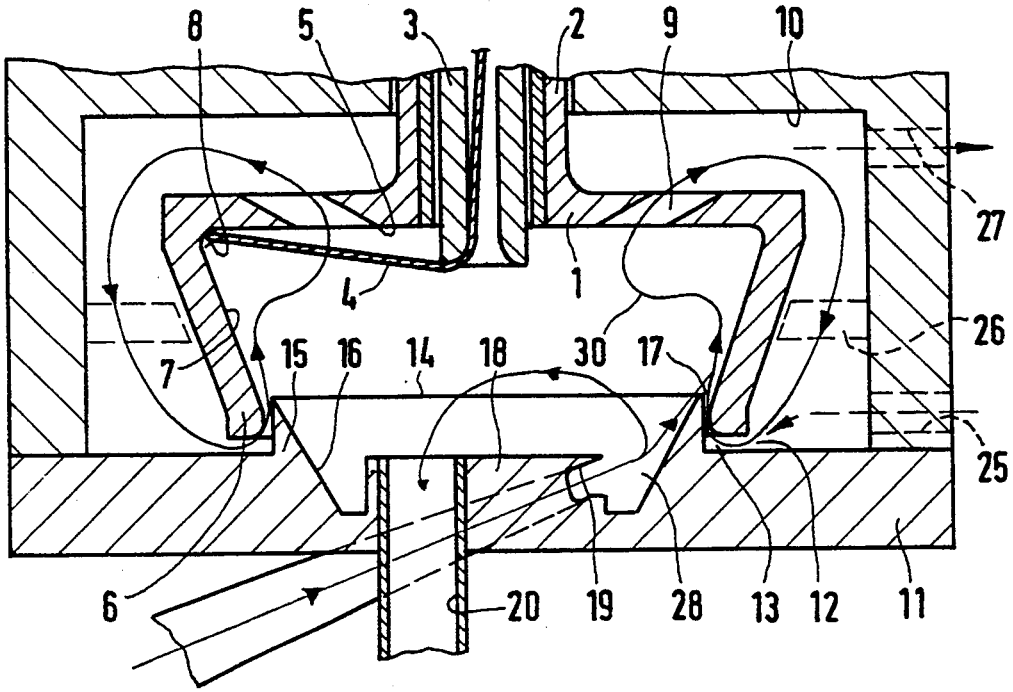
FIG. 1 shows a section of part of the open-end rotor spinning device according to the invention.

Reference will now be made in detail to the presently preferred embodiments of the inventions, one or more examples of which are illustrated in the accompanying drawings. Each example is provided by way of explanation of the invention, not limitation of the invention. The numbering of components in the drawings is consistent throughout the application, with the same components having the same number in each of the drawings.

Only those parts of an open-end rotor spinning device designed otherwise in the conventional manner which are absolutely necessary to understand the invention are shown in the figures.

A spinning rotor 1 is installed on a driven rotor shaft 2 which is rotatably mounted in a bearing box (not shown), whereby the driven shaft 2 in the shown embodiment is provided with an axial bore 3 for the withdrawal of the spun yarn 4.

The spinning rotor 1 is made in the form of a flat cup with a flat circular bottom 5 and is provided with a cylindrical neck 6 extending outward and having a smaller diameter than the above-mentioned flat bottom 5, being connected to the latter via a sliding wall 7 which tapers in the manner of a cone. The flat bottom 5 and the sliding wall 7 constitute together a fiber collection groove 8 for a fiber ring. The flat bottom 5 is provided outside the rotation axis of the spinning rotor 1 with at least one ventilation opening 9 having the effect of fan wheel.

The spinning rotor 1 is surrounded at a radial distance by a rotor housing 10 which is provided according to FIG. 1 with a removable but stationary cover 11 and which is held by its inner wall 12 at a suitable distance 13 from the forward edge of the cylindrical neck 6 of the spinning rotor 1.

A rear edge 14 of a guiding body 15 extends coaxially into the preferably cylindrical neck 6 of the spinning rotor 1 with an interior guiding surface 16 widening in the manner of a cone toward the rear edge 14 and having a conical character, at which the extended generatrix of this guiding surface 16 intersects the conical sliding wall 7 of the spinning rotor 1.

Between the open edge 14 of the guiding body 15 extending into the spinning rotor 1 and the cylindrical neck 6 of the spinning rotor 1, a ring-shaped gap 17 is provided in such manner that the rotation of the spinning rotor 1 and the entry of the air stream 30 is made possible. The guiding body 15 constitutes an integral part of the cover 11 or is attached to the latter by means of devices not shown here so that it is not rotatable, i.e. stationary.

A cylindrical, conical or otherwise shaped projection 18 on the cover 11 extends essentially in a concentric manner into the space enclosed by the guiding body 15, forming a rotation space 28 between its side and the elements of the guiding surface 16 toward it. The outlet of a fiber feeding channel 19 or of another fiber feeding device of different design which is not shown is provided on the cylinder surface of the projection 18 for the conveying of individual fibers to the guiding surface 16 of the guiding body 15. The outlet of an aspiration channel (suction line 20) connected to a negative-pressure source (not shown) is installed on the front face of the projection 18 or on some other suitable location at a distance from the outlet of the fiber feeding channel 19. A forward surface of the projection 18 can be provided with a central bore and with a draw-off suction (not shown) for the yarn 4 if the spun yarn 4 is to be withdrawn on that side of the spinning rotor 1 (see draw-off nozzle 39 in FIG. 3).

Figure 2:
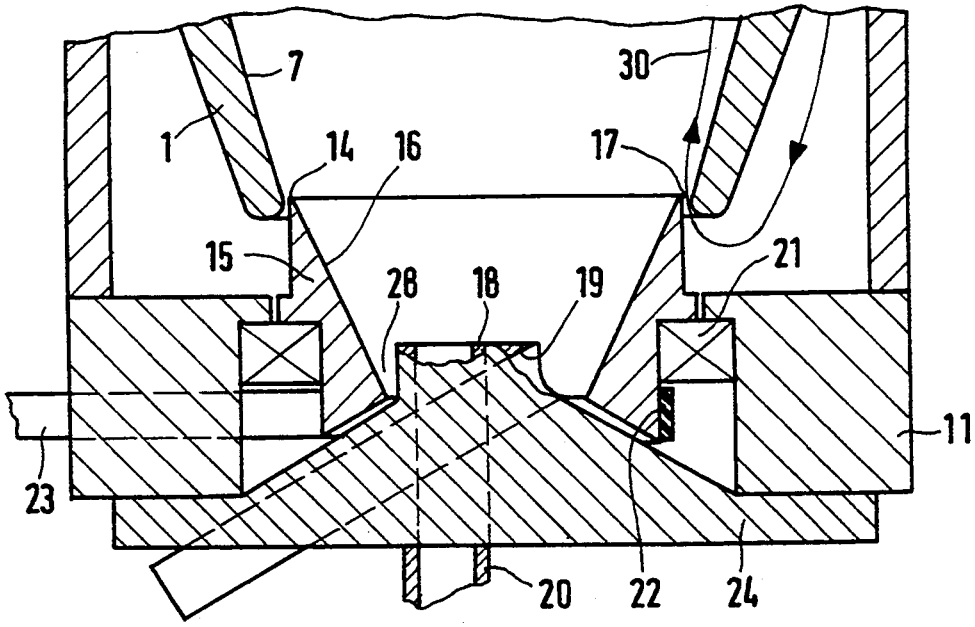
FIG. 2 shows a section of an alternative form of the device shown in FIG. 1.

In the embodiment of the spinning device according to FIG. 2 the guiding body 15 is installed rotatably in the cover 11 with the help of a bearing 21 and is furthermore provided for that purpose with a wharve 22 for an endless driving means 23 connected to a driving device (not shown). As described above, the projection 18 is located on a separate part 24 of the cover 11 attached to the outside of said cover 11. Joints between the cover 11 and the separate part 24 of cover 11 on the one hand and the rotatable guiding body 15 on the other hand are furthermore sealed off by means of a labyrinth seal etc.

In the described embodiment, the periphery of the spinning rotor 1 in which at least one ventilation opening 9 is located is connected inside the rotor housing 10 to the periphery of the outside of gap 17 between the spinning rotor and the guiding body 15, so that a circulation flow is created, leaving through the ventilation opening 9 of the spinning rotor 1 and flowing back into the spinning rotor through the gap 17. At the same time this circulation flow produces the negative pressure required for spinning around the interior of the rotor,-while overpressure is produced outside the spinning rotor 1 in the rotor housing 10.

As is shown in FIG. 1 by broken lines, the rotor spinning device can be changed so that at least part of the interior space of the rotor housing 10 around the ring-shaped gap 17 is connected by means of an opening 25 to a source of compressed air (not shown) (or is possibly connected merely to the atmosphere), whereby this part of the space in the rotor housing 10 is separated for this purpose by an intermediate wall 26 at the level of the cylindrical neck 6 of the spinning rotor (periphery of gap 17) from the rest of the space near the circular bottom 5 (periphery) of the spinning rotor 1 with at least one ventilation opening, the separated space of the rotor housing 10 near the circular bottom 5 of the spinning rotor 1 being connected to the atmosphere or to a source of negative pressure (not shown) via an opening 27.

The intermediate wall 26 is designed so that the rotation of the spinning rotor 1 is not affected. It can be part of the outer periphery of the spinning rotor 1 for example, or it can be supported by the rotor housing 10. The intermediate wall can here be formed of segments which can be shifted in the manner of a diaphragm, e.g. in the direction of the periphery of the spinning rotor 1 to regulate the described circulation flow and thereby also the intensity or the distribution of the air stream entering the ring-shaped gap 17.

The function of the rotor spinning device according to the invention is described below.

In an opener device (not shown) the fibers are combed out of a fiber sliver by means of the clothing pins of the opener rollers and are conveyed as single fibers into the fiber feeding channel 19 where they form a stream of single fibers together with the flowing air. The stream of single fibers follows the direction toward which the outlet of the guiding channel is pointing. After emerging from the outlet of the feeding channel, the fiber stream enters the rotation chamber 28 between the cylinder wall of the projection 18 and the facing, conically widening guiding surface 16 of the guiding body 15. The air which has conveyed the single fibers is deflected and sucked off through suction line 20 while the individual fibers are separated from this air stream due to their inertia and continue at an angle further into this rotation chamber 28 and on into the space of the guiding body 15 without danger that the individual fibers are sucked away through the suction line 20.

Since the spinning rotor 1 rotates at high rotational speeds when the rotor spinning machine its in operation, a rotation stream of air is produced in the interior of the spinning rotor 1, as well as in the interior of the neck 6, and therefore also in the guiding body 15 and in the rotation chamber 28. This action drives the fed fibers from the rotation chamber 28 to the stationary or rotating guiding surface 16 of the guiding body 15 where the fibers enter a continuously accelerating and rotating air layer. The conveying transfer of the fibers to this layer as well as further conveying of the fibers by means of this layer represent a continuous process in which the forward ends of the fibers are pulled along and are stretched as a result of the high speed of the above-mentioned layer.

When the rotor spinning device is in operation, the air stream entering through the ring-shaped gap 17 into the spinning rotor is deflected by the rotating spinning rotor 1 so that a rotation component in this flow supersedes the directional component determined by the axial direction of the ring-shaped gap 17. As a result centrifugal forces are produced in the air stream 30, with a considerable radial component in the entering air stream 30. As a result of this effect, a helicoidal flow of the entering air stream 30 exists and is directed along the sliding wall 7 toward the ring-shaped bottom 5 of the spinning rotor 1, where the air stream 30 is aspired through at least one ventilation opening 9 and is returned by the ventilation effect of the latter via a chamber of the rotor housing 10 in form of compressed air into the ring-shaped gap 17.

In this manner, a circulation flow is produced by the rotation of the spinning rotor 1, whereby the air stream removed from the spinning rotor 1 through the ventilation openings 9 and constituted inside the spinning rotor 1 as a stream of suction air is again reintroduced into the spinning rotor 1 through the gap 17 in form of a stream of compressed air.

The air entering the ring-shaped gap 17 which is conveyed from a separately controlled air source from the outside through the opening 25 into the rotor housing 10 acts upon the fibers in the same manner as a suction air stream being produced by ventilation opening 9. If the bottom 5 of the spinning rotor 1 is not provided with an air hole 9 (see FIG. 3), the air arriving from the outside into the ring-shaped gap 17 rises from the center of the ring-shaped bottom 5 of the spinning rotor 1 with the help of a chimney effect through the center of the relative quiet zone of the rotating pneumatic medium into the suction line 20.

The fibers transferred to the above-mentioned rotating air layer are carried over circular paths. As a result, the centrifugal force which forces the fibers to pass through the rotating air layer in the direction of the guiding wall 16 of the guiding body 16 begins to take effect. The size or length of the guiding wall 16 must be selected at least so that the fibers which have been brought into rotation penetrate the rotating air layer and reach the guiding wall 16 only in proximity of the open edge of the guiding body 15. During this process the fibers have already been stretched at their forward portions by the above-described action of the air layer, whereupon their forward portions are the first portions to reach the opening of the ring-shaped gap 17 where an intensive injection effect of the entering air stream 30 becomes noticeable. This effect thereupon fixes these fiber portions as a result of a corresponding directional component of the movement. When the fibers are aspired by their forward portions into the entering air stream 30 at the ring-shaped gap 17, these fiber portions with their radial component of the entering air stream 30 then come to bear against the sliding wall 7 of the spinning rotor 1 and are pulled at an angle over the free edge of the guiding surface 16 by an interactive effect of the rotational component of the movement of this entering air stream 30 and of the frictional forces on the sliding wall 7. Through a friction effect, the free edge of the guiding surface 16 produces a reaction force which ideally stretches the fibers as they are transferred to the sliding wall 7, whereby the fibers are imparted an overwhelmingly peripheral direction due to the high rotation of the spinning rotor 1. In this state of stretching and orientation, the fibers are then controlled mechanically at the sliding wall 7 by means of the centrifugal forces, but also by means of the radial components of the air stream 30 emerging from the ring-shaped gap 17.

The fibers in the above-described stretched and oriented state and at a peripheral speed of the sliding wall 7 coming into the collection groove then join the fiber ring (not shown) without deformations such as normally occur when the orientation, stretching and speed of the fibers fed to the fiber ring are not substantially identical with an orientation and speed of the fiber ring. A yarn with very good geometric character is thus produced.

The rotor spinning device according to the invention can be used for all known types of rotor spinning machines, in particular for the production of the yarn with a new surface character and with high-quality internal structure which proves itself especially at the high withdrawal speed of the yarn and also with low yarn twist.

As the above description shows, and independently of the special design of the device with stationary or rotating guiding body 15, an air stream 30 with a component oriented toward the bottom 5 of the spinning rotor 1 (since the guiding body 15 with guiding surface 16 extends into the neck 6 of the spinning rotor in the described embodiments) is directed through the gap 17 into the interior of the spinning rotor 1. The air is then removed through the ventilation openings 9 and/or through the suction line 20, i.e. without going through the gap 17 from the inside out, as was normally the case until now.

The object of the invention can be modified in many ways, for example, by exchanging individual characteristics against equivalents or by using them in other combinations. It has already been explained that the air stream 30 conveyed through he gap 17 into the interior of the spinning rotor 1 can be produced in different manners. For example, compressed air can be fed to the outer periphery of the gap 17, and for this at least this periphery of the gap 17 must be designed as a ring-shaped chamber (rotor housing 10). If on the other hand the air stream 30 is constituted by a source of negative pressure taking effect inside the spinning rotor 1, the rotor housing 10 may also be omitted entirely if necessary, and the air can be aspired from the atmosphere.

In any case, a device in form of a source of compressed air (not shown) or in form of a source of negative pressure taking effect inside the spinning rotor and which is to be discussed in further detail below, is provided to produce a pressure drop. This pressure drop between the outer periphery of the gap 17 and the interior of the spinning rotor 1 causes the above-mentioned air stream 30 flowing into the interior of the spinning rotor 1 to be produced.

When a negative pressure is brought to take effect in the spinning rotor 1, this can be carried out by means of one or several eccentric ventilation openings 9 located in the bottom 5 of the spinning rotor 1, i.e. the suction air stream can be produced by the rotation of the spinning rotor 1 itself. The suction air stream leaves the spinning rotor 1 through the ventilation opening(s) 9 in this case. As FIGS. 1 and 2 show, it is however also possible to provide a suction line 20 which removes the air from the spinning rotor 1 independently of the rotation of the spinning rotor 1. This suction line 20 can be installed in the cover 11 or in an element 24 supported by the cover 11, but it is also possible, if the yarn 4 is withdrawn through the cover 11 or through the part 24 which it supports (see draw-off nozzle 39 in FIG. 3), to make the rotor shaft 2 in the form of a tube and to connect it to a source of negative pressure so that the hollow rotor shaft 2 is then designed as a suction line 20.

According to FIG. 1, in which the spinning rotor 1 has at least one ventilation opening 9, the air stream 30 is removed at least in part toward the side from which the fibers are being fed by means of the fiber feeding channel 19. If, on the other hand, no ventilation openings 9 are provided in the spinning rotor 1, all the air is removed through the shown suction line 20. Especially if the air stream then leaves the interior of the guiding body 15 (as shown) essentially at a location diametrically opposed to the location at which the fibers are fed to the fiber guiding surface 16, the air stream entering the guiding body 15 through the fiber feeding channel 19 and conveying the fibers is separated in major part from the fibers through sharp deflection and is removed from the spinning device, i.e. guiding body 15 which constitutes the portion of this spinning device, while only a small residual portion of the air, in form of an air eddy, feeds the fibers to the spinning rotor. The fibers are then conveyed on a helicoidal path to the wider end, i.e. to the edge 14 of the fiber guiding surface 16, from where the fibers reach the sliding wall 7 of the spinning rotor 1 after overcoming the gap 17. The air stream 30 which enters through the gap 17 into the spinning rotor 1 prevents in that case an escape of fibers through gap 17, so that no fiber loss occurs. The fibers rather slide in a known manner along the sliding wall 7 into the fiber collection groove 8 of the spinning rotor 1 where they are incorporated in the conventional manner into the end of the continuously withdrawn yarn 4. The air which has fed the fibers to the spinning rotor 1 along the fiber guiding surface 16, as well as the air guided in the form of air stream 30 through the gap 17 into the spinning rotor 1 is removed through the suction line 20 without going again through the gap 17. Thereby defined flow conditions are obtained in the spinning rotor 1, influencing favorably the feeding of the air stream 30 and the depositing of the fibers on the sliding wall 7 of the spinning rotor 1.

The air stream which conveys the fibers from the outlet opening of the fiber feeding channel 19 to the edge 14 requires a more or less long itinerary, depending on the existing geometric and pneumatic conditions. A fiber guiding surface 16 extending over less than 360° may suffice in certain cases, so that this fiber guiding surface 16 need not be ring-shaped in such case. In any case, however, it should be made in form of part of a ring surface and be adapted to the size of the internal perimeter of the spinning rotor 1 at the fiber transfer point.

The air stream 30 is oriented as a rule parallel to the sliding wall 7, and for this the guiding body 15 is provided with an appropriate outer contour and extends into the neck 6 of the spinning rotor 1. To influence the gap size and/or to change the direction of flow, it is possible to provide for adjustability of the relative axial position of spinning rotor 1 and guiding body 15 to each other. Depending on the design, either the guiding body 15 can be adjusted axially in relation to the spinning rotor 1, or the spinning rotor 1 can be adjusted axially in relation to the guiding body 15.

Figure 3:
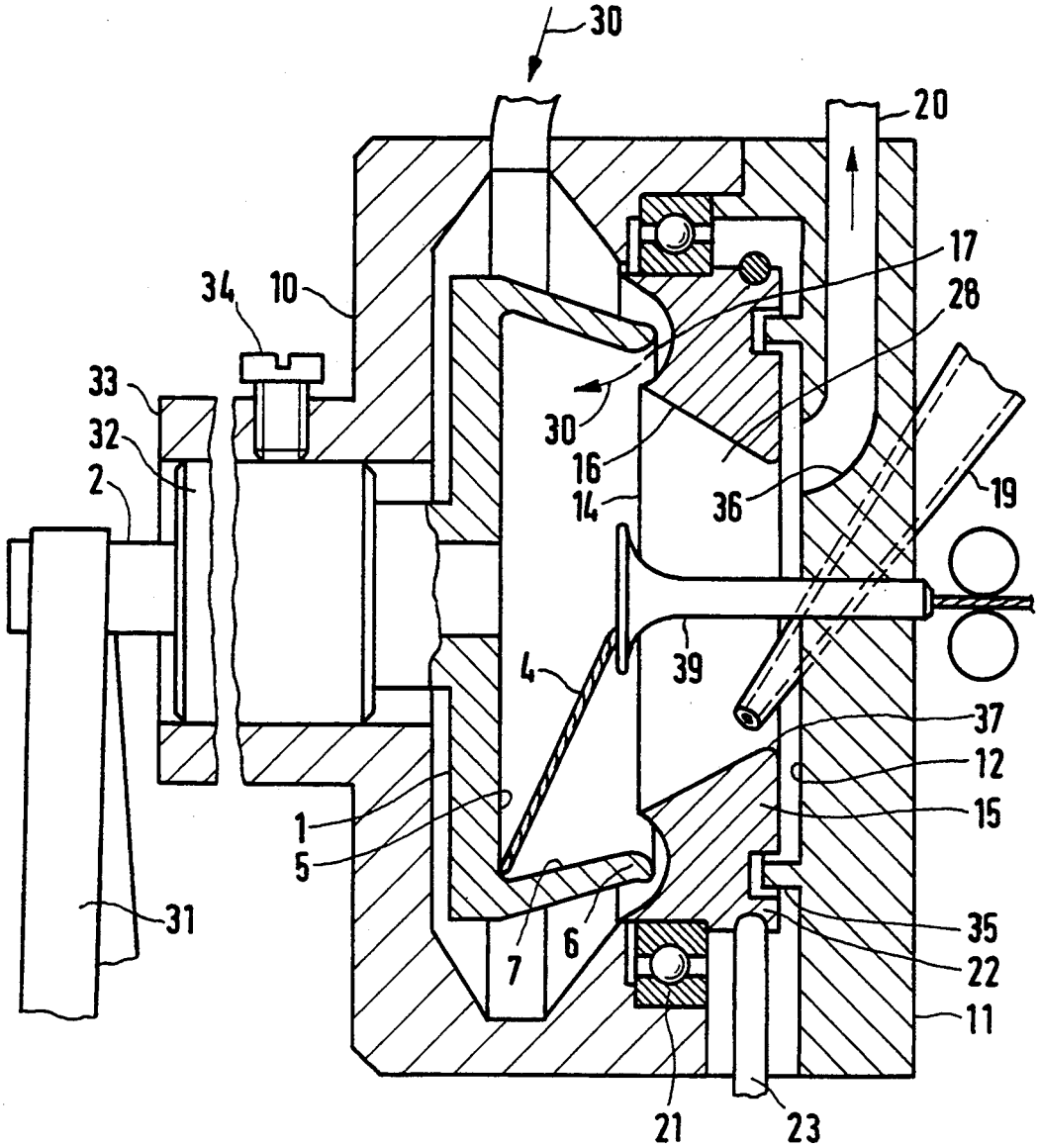
FIG. 3 show a section of another alternative form of the device according to the invention.

According to FIG. 3 the rotor shaft 2 which can be driven by the belt 31 is rotatably mounted in a bearing 32 which is in turn secured by means of a screw 34 in a sleeve-like part 33 of the rotor housing 10. Upon loosening this screw 34 the spinning rotor can be brought into the desired position in relation to the guiding body 15 for adjustment of the gap 17, and can be secured in that position by re-tightening the screw 34.

The gap width is as a rule widened through the above-described relative positioning, so that an adaptation to different fiber materials to be spun can be achieved. This adjustment can go so far if necessary that the edge of the guiding body 15 and the open edge of neck 6 are adjusted in relation to each other so that the air stream 30 flows radially through gap 17 into the rotor interior, or has only a very weak axial flow component.

Figure 4:
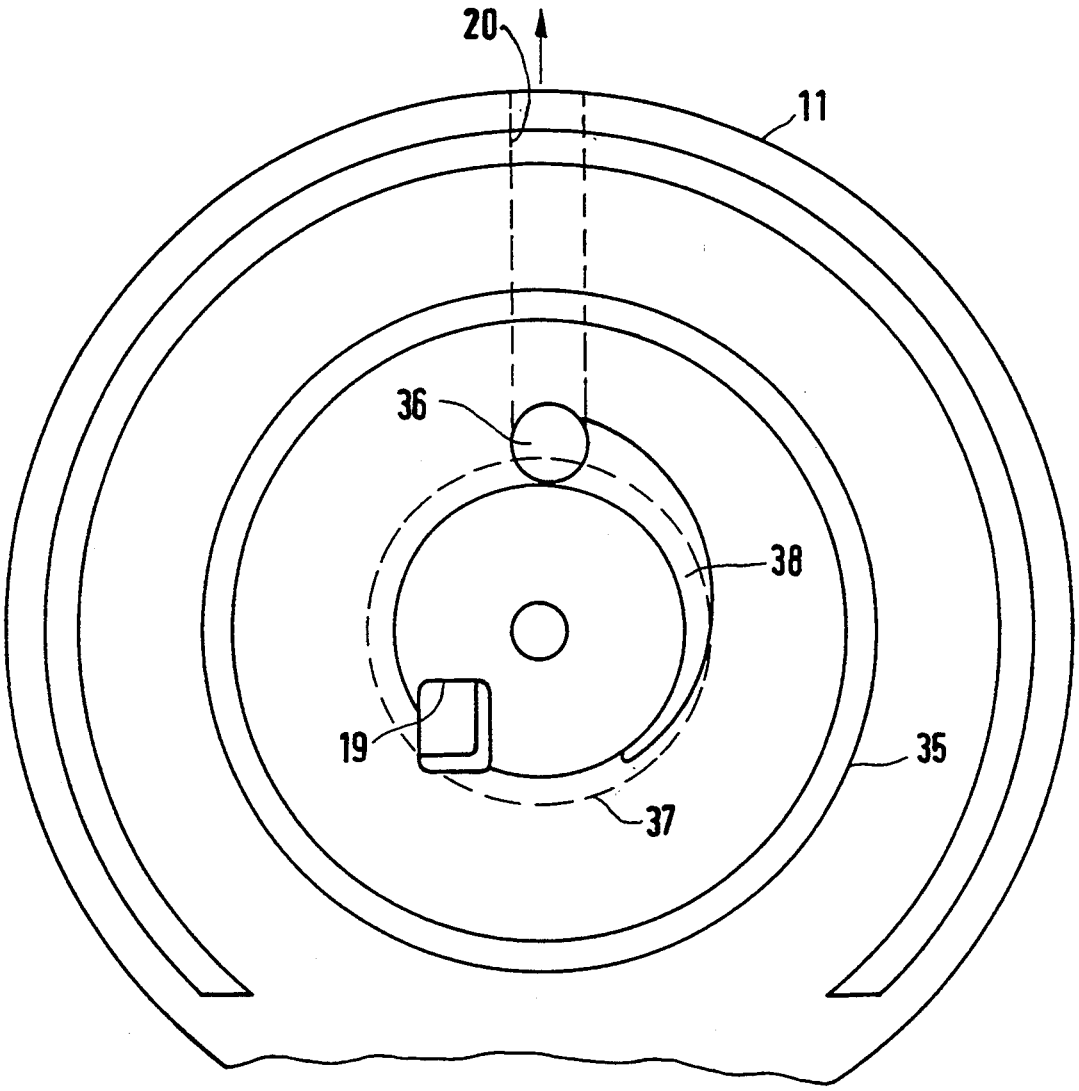
FIG. 4 shows a top view of the cover according to the invention from its side toward the spinning rotor.

In the embodiment shown in FIG. 3 the suction line 20 is also installed in the cover 11. The fiber feeding channel 19 ends in this case eccentrically within the ring-shaped fiber guiding surface 16 in a circular surface enclosed by the latter, while the outlet of the suction line 20 is located in the other half of this circular surface. FIG. 4 shows the side of cover 11 which is toward the spinning rotor 1 in operating position,, with its ring ridge 35 which is part of a labyrinth seal, the outlet of the fiber feeding channel 19 and the outlet 36 of the suction line 20. Furthermore, the edge 37 of the guiding body 15 is also shown by broken lines. As can be seen in this drawing, the outlet 36 is substantially located at the diametrically opposite location of the outlet of the fiber feeding channel 19 (in relation to the circular surface constituted by the edge 37 of the guiding body 15) in order to effect the desired deflection of the major part of the air stream flowing through the fiber feeding channel 19. In order to favor a deflection in the sense of rotation of the spinning rotor 1, a groove 38 is provided according to FIG. 4 in the face of the cover 11, said groove starting gradually and becoming larger in the direction of the outlet 36 of the suction line 20 and being made along an arc of circle.

The generatrix of the fiber guiding surface 16 is at an incline also in the embodiment of FIG. 3 which differs from the angle of the sliding wall 7 of the spinning rotor in such manner that the extension of the generatrix of the fiber guiding surface 16 intersects the sliding wall 7 between gap 17 and the fiber collection groove 8.

It will be apparent to those skilled in the art that various modifications and variations can be made in the present invention without departing from the scope or spirit of the invention. For instance, features illustrated or described as part of one embodiment can be used on another embodiment to yield a still further embodiment. It is intended that the present invention cover such modifications and variations as come within the scope of the appended claims and their equivalents.

We claim:

1. A process for spinning yarn by means of an open-end spinning machine with a spinning rotor having a widening fiber sliding surface to which fibers are conveyed by way of a fiber guiding surface oppositely facing the spinning rotor which widens towards the spinning rotor, said process comprising defining a gap between the fiber guiding surface and the widening fiber sliding surface, establishing an air stream through the gap into an interior of the spinning rotor, and directing the airstream out of the interior of the spinning rotor without going through the gap so that a continuous air stream is drawn through the gap and directed generally along the widening fiber sliding surface of the spinning rotor thereby drawing fibers from the fiber guiding surface across the gap and into the interior of the spinning rotor.

2. The process as in claim 1, including producing the air stream passing through the gap into the interior of the spinning rotor by means of compressed air directed generally from an outer periphery of the spinning rotor into the gap.

3. The process as in claim 1, including producing the air stream passing through the gap into the interior of the spinning rotor through by negative pressure within the spinning rotor by creating a suction force within the interior of the spinning rotor.

4. The process as in claim 3, including creating the suction force through rotation of the spinning rotor.

5. The process as in claim 4, whereby the air stream created by rotation of the spinning rotor is re-introduced into the gap so that a substantially continuous recirculating air stream is established.

6. The process as in claim 1, including directing the air stream out of the interior of the spinning rotor generally at the same relative radial position of the spinning rotor corresponding to the radial position from which the fibers are being drawn into the rotor.

7. The process as in claim 6, further comprising conveying the fibers to the fiber guiding surface by means of a first airstream and including directing the first air stream out of the interior of the spinning rotor at a location generally radially opposite to the location of the fiber feeding into the spinning rotor.

8. The process as in claim 1, further comprising initially directing the fibers from an opener device to the fiber guiding surface by means of a first air stream, deflecting the major portion of the first air stream away from the spinning rotor, directing the remaining portion of the first air stream together with the fibers in a helicoidal path to the wider end of the fiber guiding surface and across the gap.

9. The process as in claim 1, including directing a component of the air stream established through the gap into the interior of the spinning rotor towards the bottom of the spinning rotor.

10. The process as in claim 1, including adjusting the air stream established through the gap into the interior of the spinning rotor according to the type of fiber material being spun into yarn.

11. The process as in claim 10, including adjusting the air stream by varying the gap width.

12. An open-end spinning device, comprising:

a spinning rotor defining a fiber sliding surface and fiber collection groove therein, and a housing containing the spinning rotor;

a fiber guiding surface configured for directing fibers into an interior of said spinning rotor whereby a gap is defined between said fiber guiding surface and said spinning rotor fiber sliding surface;

a fiber feeding device configured to feed fibers to said fiber guiding surface; and means for establishing a pressure drop across said gap so that an air stream is established from outside the interior of said spinning rotor, through said gap, and into the interior of said spinning rotor, said air stream causing fibers from said fiber guiding surface to be drawn across said gap and generally along said spinning rotor fiber sliding surface to said fiber collection groove.

13. The device as in claim 12, wherein said pressure drop means comprises a compressed air source directed towards said gap from outside the interior of said spinning rotor.

14. The device as in claim 13, wherein said compressed air source includes a passage defined through said rotor housing.

15. The device as in claim 12, wherein said pressure drop means further comprises means defined in said rotor for creating a negative pressure within the interior of said spinning rotor.

16. The device as in claim 15, wherein said negative pressure means comprises at least one ventilation opening located eccentrically in the spinning rotor, the rotation of said spinning rotor causing said air stream to be drawn through said gap and out of said spinning rotor through said ventilation opening.

17. The device as in claim 16, further comprising a first and a second opening defined in said rotor housing, said airstream being drawn through said first opening, through said gap, out said ventilation opening, and out said second opening.

18. The device as in claim 17, further comprising an intermediate wall defined between said first and second openings.

19. The device as in claim 18, wherein said intermediate wall is carried by said rotor housing.

20. The device as in claim 19, wherein said intermediate wall is radially adjustable relative said spinning rotor so as to regulate said air stream.

21. The device as in claim 16, wherein said air stream comprises a continuously recirculating airstream that is drawn through said gap, into the interior of said spinning rotor, out said ventilation opening, and back into said gap.

22. The device as in claim 16, wherein a peripheral area of said spinning rotor adjacent said ventilation opening is in communication with the atmosphere, and a peripheral area of said gap is in communication with an overpressure source.

23. The device as in claim 16, wherein a peripheral area of said spinning rotor adjacent said ventilation opening is in communication with a peripheral area of said gap, whereby a continuous recirculating air stream is generated through said gap.

24. The device as in claim 15, wherein said negative pressure means includes an intake opening of a suction line disposed on the same side of said gap as said fiber feeding device and configured to take a suction from the interior of said spinning rotor.

25. The device as in claim 24, wherein said fiber feeding device includes a fiber feeding channel, said fiber guiding surface including a ring-shaped device, said fiber feeding channel ending in the area surrounded by said ring-shaped device, and said suction line intake opening disposed in said ring-shaped device generally radially opposite said fiber feeding channel.

26. The device as in claim 25, further comprising a rotor housing cover configured to cover said rotor housing, said ring-shaped device being an integral part of said rotor housing cover.

27. The device as in claim 26, wherein said rotor housing cover further comprises a groove defined in the area defining said ring-shaped device along an arc of a circle between the end of said fiber feeding channel and said suction line intake opening, said groove gradually widening in the direction of said suction line intake opening.

28. The device as in claim 26, wherein said rotor housing cover comprises a projection projecting essentially concentrically into the space enclosed by said ring-shaped device, said projection being provided with said fiber feeding channel and said suction line intake opening.

29. The device as in claim 12, wherein said fiber guiding surface extends into the interior of said spinning rotor.

30. The device as in claim 29, wherein the end of said fiber guiding surface extending into the interior of said spinning rotor is oriented so that it is adjacent said fiber sliding surface between said gap and said fiber collection groove.

31. The device as in claim 12, wherein said fiber guiding surface is non-rotatable relative said spinning rotor.

32. The device as in claim 12, wherein said spinning rotor and said fiber guiding surface are axially adjustable relative each other.

33. The device as in claim 12, wherein said widening fiber guiding surface is oriented so that its extension intersects said fiber sliding surface between said gap and said fiber collection groove.

* * * * *